US008757510B2

(12) United States Patent
Wirthwein et al.

(10) Patent No.: US 8,757,510 B2
(45) Date of Patent: Jun. 24, 2014

(54) LATERALLY DISPLACEABLE RAIL FASTENING

(75) Inventors: Udo Wirthwein, Creglingen (DE); Joachim Süss, Dresden (DE)

(73) Assignee: Wirthwein AG (DE)

( * ) Notice: Subject to any disclaimer, the term of this patent is extended or adjusted under 35 U.S.C. 154(b) by 437 days.

(21) Appl. No.: 12/484,529

(22) Filed: Jun. 15, 2009

(65) Prior Publication Data

US 2009/0308943 A1 Dec. 17, 2009

(30) Foreign Application Priority Data

Jun. 13, 2008 (DE) ..... 10 2008 028 092

(51) Int. Cl.
*E01B 9/00* (2006.01)

(52) U.S. Cl.
USPC ..... 238/361

(58) Field of Classification Search
USPC ..... 238/264, 287, 292, 304, 310, 315–319, 238/324–326, 361, 362
See application file for complete search history.

(56) References Cited

U.S. PATENT DOCUMENTS

| | | | | |
|---|---|---|---|---|
| 1,069,484 A | | 8/1913 | Smith | |
| 1,833,375 A | | 5/1931 | Schumann | |
| 4,312,477 A | * | 1/1982 | Hixson | 238/304 |
| 4,770,342 A | * | 9/1988 | Farrell et al. | 238/347 |
| 4,907,740 A | * | 3/1990 | Oberweiler et al. | 238/283 |
| 5,094,387 A | * | 3/1992 | Rice et al. | 238/23 |
| 6,758,406 B2 | * | 7/2004 | Weaver | 238/315 |

FOREIGN PATENT DOCUMENTS

| | | | | | |
|---|---|---|---|---|---|
| DE | 45741 | A1 | | 1/1889 | |
| DE | 521209 | C1 | | 3/1931 | |
| DE | 2717394 | A1 | | 10/1978 | |
| DE | 3324225 | A1 | | 1/1985 | |
| DE | 3708752 | A1 | | 9/1988 | |
| DE | 4007937 | A1 | | 9/1991 | |
| DE | 29507974 | U1 | | 9/1995 | |
| DE | 29520973 | U1 | | 8/1996 | |
| DE | 29702708 | U1 | | 6/1997 | |
| DE | 19642971 | A1 | | 9/1997 | |
| EP | 0223897 | B1 | | 7/1989 | |
| EP | 0149513 | B1 | | 12/1989 | |
| EP | 0962592 | B1 | | 4/2004 | |
| FR | 1064956 | A | | 5/1954 | |
| GB | 2214545 | A | * | 1/1988 | E01B 9/30 |
| GB | 2214545 | A | * | 9/1989 | E01B 9/30 |

* cited by examiner

*Primary Examiner* — R. J. McCarry, Jr.
(74) *Attorney, Agent, or Firm* — Paul and Paul

(57) ABSTRACT

The invention relates to a rail fastening on a tie having fastening screws and loop-shaped tension clamps in which the track width can be adjusted horizontally in a stepless manner using wedge elements, the rail being arranged on a ribbed plate, the ribs of which run at an angle to the rail and a wedge that can be moved in the longitudinal direction of the rail being arranged between rail foot and the ribs. The wedge is preferably guided on the support. This makes possible effective horizontal lateral displacement of the rail or modification of the track with the use of simple and inexpensive plastic parts.

17 Claims, 3 Drawing Sheets

LATERALLY DISPLACEABLE RAIL FASTENING

The invention relates to a rail fastening on a tie having fastening screws and loop-shaped tension clamps in which the track width can be adjusted horizontally in a stepless manner using wedge elements.

In addition, a few variants are known in the prior art that correspond approximately to the aforesaid genre.

It is possible to compensate rail tolerances or track width tolerances in a stepless manner to approximately +/−10 mm using angle guide plates that are for instance from the system in accordance with publication DE 33 24 225 A1. Such angular guide plates are used with concrete ties or a ballastless track. The adjustable part to the side of the rail is secured by a tension clamp after the two wedge-shaped parts are adjusted to the correct track width relative to one another in a stepless manner. It is disadvantageous that this system can only be used for rigid rail support points and no dynamic load is permitted for the adjusting part. There is no displacement on the rail foot.

Publication GB 2214545 A describes a similar arrangement with an alternative spring. The problems are the same as those described in the foregoing.

In accordance with EP 962592 B1, angular guide plates are used in combination with separate spacers in concrete ties or a ballastless track to regulate track width. This is impractical because up to 3000 spacers that have a different width matched to each support point would be needed per km of track length.

The Gantry fastening, primarily for crane rail fastening, was available on the Internet at http://www.krug-weichenbau.de/seiten/gantrail/3224_20. pdf on 13 Jun. 2008 at 3:03 p.m. Publication DE 40 07 937 A1 provided similar subject matter. Displacement is made possible by angled slits about a fixed, concrete-set, or welded screw in the fastening part, of a displaceable clamping plate. A resilient rail fastening is only possible indirectly by arranging a resilient mat under the rail; otherwise only the rail is clamped. Reliable transmission of the horizontal forces is not possible because the fastening elements are displaced. Use is only for rigid rail support points.

Moving the ribbed plate or base plate with the rail has been suggested with DE 37 08 752 A1 for steel ties that have longitudinal slots or grooves in addition to a ribbed plate and with DE 29 52 0973 U1 for a concrete sole plate as well; this does not enable correcting rail foot tolerances. Variants in which the screws, including suitable clamping plates, can be moved horizontally on the rail foot have been disclosed in U.S. Pat. No. 1,833,375 A1, U.S. Pat. No. 1,069,484 A1, DE 521 209 C1, and DE 45 741 A1.

DE 295 07 974 U1 discloses the so-called MX fastening. The issue is displaceability by means of eccentric disks as clamping plates, arranged about a fixed screw. Although the track can be corrected with the clamp for the rail foot, it is not possible to reliably apply horizontal force and no resilient rail fastening is possible; rather it is only possible to clamp the rail at rigid rail support points. This type of eccentric fastening and modifications thereof have been suggested frequently, for instance in EP 149 513 B1, EP 223 897 B1, DE 297 02 708 U1, and FR 1 064 956 A.

One alternative to this was introduced as the SKL15MX20 fastening in DE 196 42 971 A1. This is a combination of MX fastening with tension clamp and is thus also suitable for elastic support points, but only with indirect support point fastening on the support structure. Displaceability is not improved by this, however, but rather this secures the adjusting parts using the clamp SKL 15, which is known per se.

Finally, DE 27 17 394 A1 suggested using, on a concrete sole plate, a support plate having lifted flanges lateral to the rails as a rail support, with an elastic intermediate plate interposed. The rail foot is held down from above by means of a loop spring using lateral retention blocks and screws that pass through longitudinal slots in the latter for anchoring the rail to the concrete sole plate. Support screws with a counterbearing in the flanges can displace the retention blocks, and thus the rail foot relatively, horizontally to the track correction. The support screws must be secured in their position.

The unavoidable tolerances in the production of materials for fastening rails to a support structure and the increasing opposing need for tracks that are extremely geometrically precise require elements in the rail support points, which elements can be adjusted horizontally and with which the rails can be corrected in terms of their position relative to one another, but which also satisfy all safety requirements, even for dynamic loads. Under practical conditions it was found that there is a need for a technically simple, steplessly adjustable solution that can be used both for rigid support points, e.g. on ties, but also for elastic rail support points for ballastless track and that enables resiliently elastic fastening of the rails for dynamic loads.

Proceeding from the first aforesaid prior art, the underlying problem of the invention is to find an improved variant with which there is direct fastening for rigid and elastic rail support points and a simultaneous horizontal adjusting element and a clamp that assures fastening.

The problem is attained using the features of Claim 1. Refinements of the invention can be found in the dependent claims.

The solution includes a rail fastening on a tie having fastening screws and loop-shaped clamps in which the track width can be adjusted horizontally in a stepless manner via wedge elements, the rail being arranged on a ribbed plate, the ribs of which run at an angle to the rail, and a wedge that can be moved in the longitudinal direction of the rail being arranged between rail foot and ribs.

Preferably the wedge can be guided on the support, effectively in that the support for the wedge has a lower and an upper guide. In the design of one variant, the upper guide is embodied as a projection of the rib that extends across the wedge. The lower guide can for instance project from the support as a projection, but can also itself be a part of the rib.

The wedge can comprise plastic, for instance a very strong polyamide, and the support can, as well.

Among the advantages of the invention:

- direct fastening of the rail support point to the substructure with simultaneous elastic rail bracing
- stepless adjustability
- can be used for elastically and non-elastically borne rail support points.
- non-positive fit securing of the adjusting element With the invention, effective horizontal lateral displacement of the rails or track adjustment for the rail is possible using simple and inexpensive plastic parts.

The invention shall be explained to one skilled in the art using exemplary embodiments in figures.

Figure 3A:
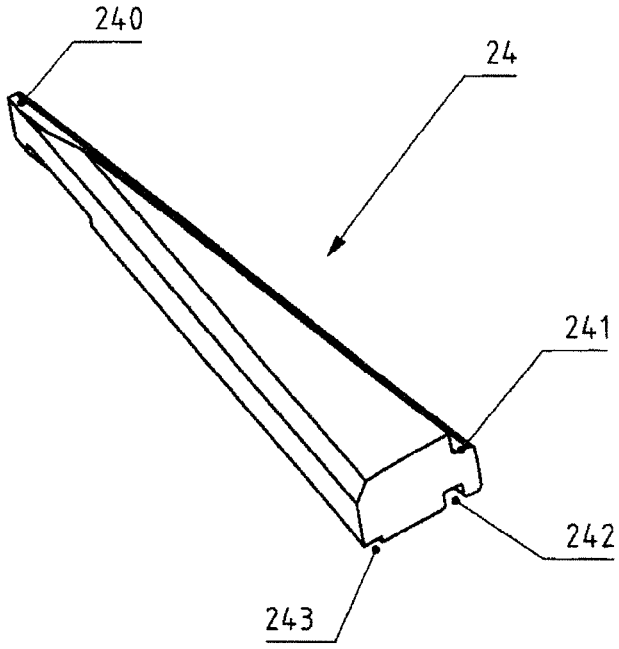
Figure 3B:
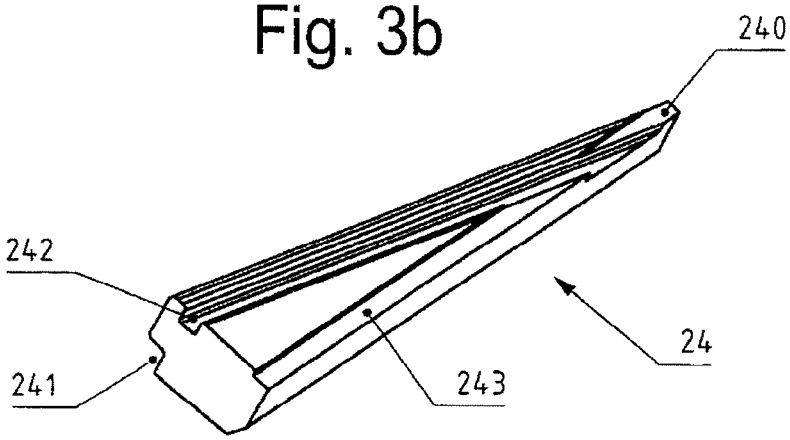

FIG. 3*a* is a perspective top view of a wedge that is used in the invention;

FIG. 3*b* depicts the bottom of the wedge in accordance with FIG. 3*a;*

Figure 4:
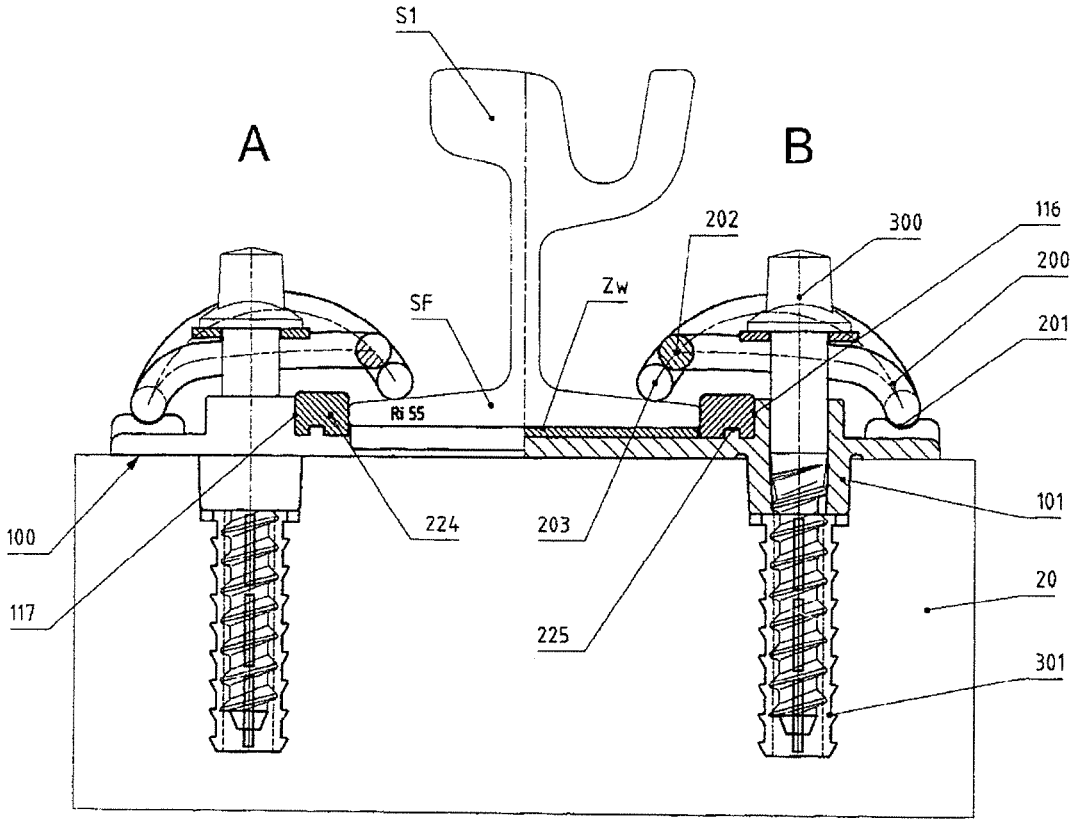

FIG. 4 depicts a second embodiment of the invention in a view transverse to the rails, in partial cross-section.

In the following, identical parts or parts with the same function are labeled with the same reference number.

Figure 1:
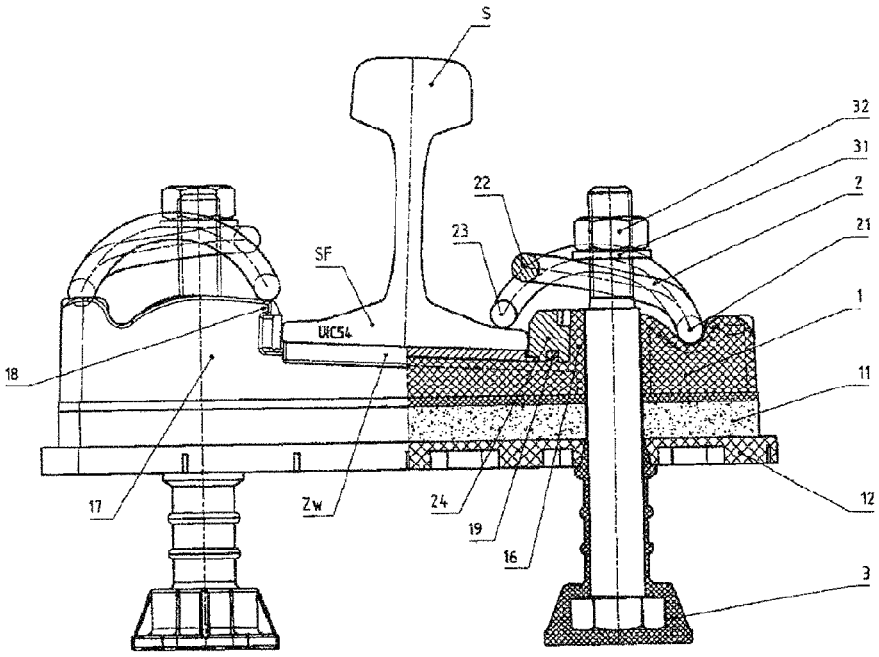
FIG. 1 depicts a first embodiment of the invention on a very elastic rail support point for a concrete tie or similar subsurface, viewed transverse to the rail, in partial cross-section.
Figure 2:
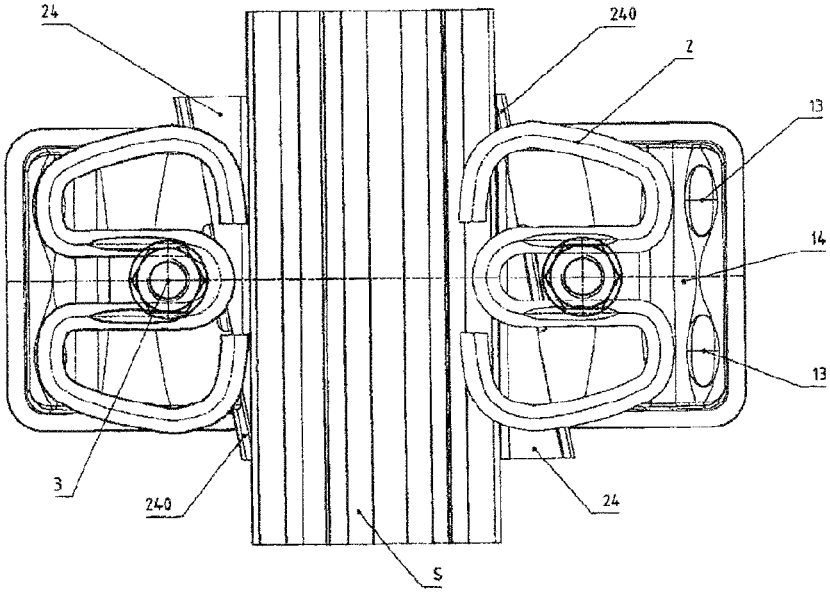
FIG. 2 is a top view of an embodiment in accordance with FIG. 1.

The very elastic support point depicted in FIG. 1 and FIG. 2 is known in principle from WO 2005/073466 A1; the disclosure in that document is cited herein because it is required to understand the embodiment. The present embodiment additionally includes track displacement. A support plate 1, where necessary including additional elastic or stiffening plates 11, 12, is anchored on a concrete tie (not shown) by means of an anchor and integrated bolt 3. The rail S, type UIC 54, with an intermediate plate ZW interposed, rests with its rail foot SF on the support plate 1, which in its principle cross-section is structured like a ribbed plate with ribs 17, 16, but here is not forged or rolled, but rather is made of plastic. A wedge 24 (FIG. 3*a, b*) is arranged between the rail foot SF and the ribs 17, 16.

In the left-hand portion of both figures, the rail fastening, which also includes a loop spring 2, held to the bolt 3 by means of washer 31 and nut 32, is depicted in the pre-assembly position, while the right-hand portion of the image depicts the spring 2 nearly in its final position. Fastening of the spring 2 has been concluded when the loop 22 is located against the wedge 24 and holds the latter in a non-positive fit from above (usage position). The pre-assembly position depicts the spring 2 hardly clamped with the rear loop 21 on counterbearing 13 of the plate 1 and the front loop ends 23 on the rib 17. In the right-hand drawing, the rear loop 21 rests in the counterbearing 14 and the loop ends 23 press the rail foot SF downward. In the top view it is evident that the ribs 17,16 run at an angle to the edge of the rail foot SF. The tip 240 of the wedge 24 can be threaded through the hole in the rib 16 and then fixed, inserted further until it assumes the position depicted in FIG. 2. The same applies to the wedge 24 adjacent to rib 17.

The wedge 24 has two guide grooves, shaped on top as a recess 241 and on the bottom as a groove 242. The upper recess 241 is guided under the catch 18 of the rib 17 or of the rib 16. The groove 241 is guided using a projection 19 on the plate 1; the wedge 24 is thus guided precisely between the ribs 17, 16 and the rail foot SF. Laterally the wedge 24 is in contact with the rail foot SF and with the ribs 17, 16 and thus can exert a horizontal pressing force against the rail foot SF. The wedge 24 on the left and/or on the right is inserted until the desired rail foot position is achieved.

When needed, the wedge 24 can have another notch 243 in order to admit air for the intermediate layer ZW.

FIG. 4 depicts a second embodiment of the invention being used in a type Ri55 grooved rail S1, anchored on a wooden tie 20. In this case the support plate 100 is equipped with ribs 117, 116 that also run at an angle and leave space for a modified wedge 224 that is placed in the same manner as described for FIGS. 1-3*a, b*. However, the wedge 224 has only a lower groove that is guided by the projection 225 on the support 100. The support 100 has been cast from polyamide. Its collar 101 projects into depressions in a bore hole for anchoring the fastening screw 300 that is additionally fixed in the wooden tie 20 by an anchor 301 having a sharp-edged outer profile. The left-hand portion A of the drawing again depicts a pre-assembly position for screw 300 and a type SKL 1 loop spring. The right-hand portion B of the drawing depicts the fastening with the screw 300 and loop spring 200 nearly in the usage position; the usage position is attained when the loop 201 rests as depicted in the counterbearing on the rear part of the support 100, the loop ends 203 securely hold the rail foot SF down, and (as in FIG. 2) the center loop 202 presses the wedge 224 from above in a friction fit.

The invention claimed is:

1. A fastening to fasten a rail to a tie or rail bed that allows for track width adjustment, the rail having a rail foot, said fastening comprising:

a support plate (1, 100) receiving the rail in transverse orientation thereto, said support plate having a pair of juxtaposed ribs (16, 17, 116, 117) extending in parallel, one on either side of said rail foot and adjacent thereto, said support plate ribs extending at an oblique angle relative to a longitudinal direction of the rail and at an angle to said rail foot;

a pair of wedges (24, 224) extending in opposite directions, one each between a respective rail foot and a support plate rib adjacent thereto;

wherein the rail foot is fastened to said support plate with a spring tension clamp (2, 200) having a loop end pressing said rail foot downward and wherein each said wedge is positioned between a respective support plate rib and said rail foot having been such positioned in a stepless manner to steplessly horizontally adjust the rail foot location on the support plate.

2. The fastening in accordance with claim 1, characterized in that each said wedge has a bottom notch (242), and said support plate includes a separate guide (19) engaging a respective wedge bottom notch (241).

3. The fastening in accordance with claim 2, characterized in that said support plate separate guide is an upward projection (19), and wherein said support plate also includes an upper guide (18) engaging said wedge.

4. The fastening in accordance with claim 3, characterized in that said upper guide is a catch (18) projecting from the rib to extend toward the rail across said wedge.

5. The fastening in accordance with claim 3, characterized in that each respective wedge has a top notch (241) which engages a respective catch (18) projection from a rib.

6. The fastening in accordance with any one of claims 1 through 5, characterized in that each wedge is comprised of a plastic material.

7. The fastening in accordance with any one of claims 1 through 5, characterized in that each said support plate is comprised of a plastic material.

8. The fastening in accordance with claim 7, characterized in that said spring tension clamp is a loop shaped clamp with plural loops.

9. The fastening in accordance with claim 7, characterized in that said support plate has a pair of counter bearings on each side of said rail, one for each of said looped shaped clamp loops.

10. The fastening in accordance with claim 9, characterized in that said loop shaped tension clamp (2, 200) is an SKL clamp.

11. The fastening in accordance with claim 6, characterized in that said wedge plastic material is polyamide.

12. A fastening to fasten a rail to a tie that allows for track width adjustment, the rail having a rail foot, said fastening comprising:

a support having a rib and a wedge;

wherein the rail is arranged on and fastened to said support using fastening screws and a loop shaped tension clamp, said rib of said support runs at an oblique angle relative to a longitudinal direction of the rail and at an angle to the rail, and said wedge can be moved in the longitudinal direction of the rail and is arranged between the rail foot and the rib;

wherein said support has a first counter bearing for the rear loop of said loop shaped tension clamp when said loop shaped tension clamp is in a pre-assembly position and a second counter bearing for the rear loop when said loop shaped tension clamp is in a usage position, in which a loop end presses said rail foot downward.

13. The fastening in accordance with claim 12, wherein said support includes a lower guide for said wedge which lower guide projects from said support as a projection.

14. The fastening in accordance with claim 12, characterized in that said support has an upper guide for said wedge which upper guide is embodied as a projection of said rib and extends across said wedge.

15. A fastening to fasten a rail having rail feet to a tie, wherein there is provided a stepless horizontal adjustment of said rail feet position with respect to said support, said fastening comprising:

a support plate, said support plate receiving said rail in a transverse position thereto, said support plate including bearing structures on either end thereof, said bearing structures terminating in a rib proximate to said rail, wherein said ribs extend in parallel to one another at an oblique angle relative to a longitudinal direction of the rail and at an angle to said transverse positioned rail feet;

a pair of wedges facing in opposite directions to one another, each positioned between a respective rib and a respective rail foot to be engaged therewith, to exert a horizontal force, longitudinally of said support plate extension, against a rail foot as a said wedge is moved inwardly in a stepless manner wherein a loop end of a tension clamp is arranged to press said rail foot downward.

16. The fastening of claim 15, also including:

a pair of upwardly extending projections from said support plate, each being positioned adjacent a rib between said rib and a respective rail foot; and a catch extending from the top of each said rib towards said rail;

wherein a wedge engages a respective upward extending projection and a catch.

17. The fastening of claim 16, also including:

a pair of loop springs, one each engaging a respective foot of said rail and a respective one of said bearing structures and being attached to exert pressure thereon;

wherein said bearing structures are counter bearing structures;

wherein one loop of said loop springs engages a said rail foot, and wherein said loop spring has two other loops and said bearing structure has a counter bearing structure engaged by each said other loops of said loop spring.

* * * * *